United States Patent [19]

Schaupp et al.

[11] Patent Number: 4,751,898

[45] Date of Patent: Jun. 21, 1988

[54] COOLANT LOSS VALVE FOR ENGINE PROTECTIVE SYSTEM

[75] Inventors: Richard E. Schaupp; Robin B. MacDonald, both of Modesto, Calif.

[73] Assignee: Parker-Hannifin Corporation, Cleveland, Ohio

[21] Appl. No.: 78,617

[22] Filed: Jul. 28, 1987

[51] Int. Cl.[4] ..... F01P 7/14; F01P 7/16

[52] U.S. Cl. ..... 123/41.08; 236/34.5

[58] Field of Search ..... 123/41.01, 41.08, 41.09, 123/41.02, 198 D; 236/34.5

[56] References Cited

U.S. PATENT DOCUMENTS

| | | | |
|---|---|---|---|
| 3,877,455 | 4/1975 | Goodwin | 123/198 D |
| 4,140,089 | 2/1979 | Kueny et al. | 123/41.08 |
| 4,327,673 | 5/1982 | Schroeder | 123/41.08 |
| 4,359,972 | 11/1982 | Calkins | 123/41.08 |
| 4,386,584 | 6/1983 | Calkins | 123/41.08 |
| 4,674,449 | 6/1987 | Hundertmark | 123/41.08 |

OTHER PUBLICATIONS

"CL-79" Model Parts List by Sentinel Mfg. Co., Inc. (1984).

*Primary Examiner*—Raymond A. Nelli

*Attorney, Agent, or Firm*—Joseph B. Balazs

[57] ABSTRACT

An improved valve, responsive to the loss of coolant under pressure in a diesel engine or the like, to open and allow fluid flow downstream with a consequent loss in fluid pressure, which is recognized by a pressure sensitive fuel valve supplying fuel flow to the engine. The coolant loss valve includes a three-part housing having the periphery of an elastomeric rolling diaphragm trapped between two housing parts and forming a coolant chamber. A spring-loaded piston and pin assembly transmit diaphragm movement, the pin forming a valve controlling fluid flow through a die cast aluminum head structure which is the third part of the housing. A stainless steel pin is used for corrosion resistance and is supported for axial movement in a dual quad ring seal and sleeve structure.

12 Claims, 1 Drawing Sheet

COOLANT LOSS VALVE FOR ENGINE PROTECTIVE SYSTEM

BACKGROUND OF THE INVENTION

The invention relates to fluid valves and more particularly to a coolant loss valve used typically in a protective system for diesel engines and the like.

Such protective system is shown, for example, in U.S. Pat. No. 3,877,455. Here, fuel is supplied to a master valve and then routed to an engine so long as certain conditions are met. Among these conditions are sufficient oil pressure, coolant pressure and a lack of excessive engine heat and devices are provided for sensing these parameters and controlling the flow of fuel to the engine. In a typical system as shown in the patent, the master control valve includes an oil pressure responsive piston which serves to hold the fuel valve open so long as sufficient oil pressure exists in the engine. The downstream side of the pressurized oil system supplied to the piston is routed in a parallel connection to a heat valve and a coolant loss valve. Both of the valves remain in a closed condition to prevent dumping of the oil under pressure to the sump of the system, which maintains the master control valve in an open position. The master control valve will be closed upon loss of oil pressure, either due to a failure in the engine itself or due to the opening of the coolant loss valve or the heat sensor valve, under predetermined excess or loss conditions.

In coolant loss valves of this type a metal or elastomeric diaphragm is used for responsiveness to coolant pressure to provide linear motion to a valving element which then controls fluid flow, such as oil under pressure, through a main valve orifice. Normally, the valve is closed by coolant pressure and spring means are used to bias the valving element to a normally open position so that upon loss of coolant pressure, the valve will be opened and the fluid at the main valve routed to the sump. In the above-noted patent the actual valve element is an elastomeric disc which is resiliently biased by means of a separate spring to accommodate variable positioning, tolerance variations and the like. Since the coolant loss valve usually operates in a closed condition under coolant pressure it is necessary that the valve operate consistently and repeatedly in this situation and under loss of pressure to move to an open position under the spring bias. Any contamination of the valve could prevent proper operation and the failure to move to an open condition when appropriate could be costly and possibly contribute to a dangerous condition. Since the oil under pressure being controlled is usually contaminated to a certain degree, even though filters are used throughout a typical engine system, this problem is accentuated and it is difficult to design a reliable and consistently operable valve. Further, it is necessary to have a valve design which is efficient and functional and yet be relatively inexpensive as the engine systems are subject to close scrutiny and periodic maintenance.

Another form of coolant loss valve known as the Sentinel Model CL-79 has been widely used in the past. This valve uses a square elastomeric diaphragm and spring-loaded disc holder assembly, the latter being a relatively complex structure comprising a molded plastic stem and valve cup having a snap-in elastomeric seal disc and requiring a nylon washer retainer and specially configured elastomeric seal for sealing the stem of the assembly. The stem is slidably supported in an internal bore of the housing but is subject to contamination in spite of the seals and is subject to premature failure. Further, the main valve seat in this unit is a special relatively expensive stainless steel grommet pressed in place during assembly and chosen to avoid contamination buildup at this critical location.

SUMMARY OF THE INVENTION

The coolant loss valve of this invention has been designed to avoid many of the limitations of prior art devices and yet is a relatively simplified structure which provides repeatable and reliable valve openings and closures. This is achieved in a three-part body structure valve housing in which the main valve is formed in a die cast aluminum housing portion and the remainder in injection molded plastic housing parts. A circular elastomeric diaphragm is employed which is secured between housing parts and which helps to seal the body parts, avoiding further body seals. However, the essential feature of this coolant loss valve is the use of a simplified piston and pin assembly which reduces the number of parts required which increases the reliability of the unit while reducing the cost thereof.

A stainless steel pin is used as the main valving element connected directly to the piston which in turn engages and follows diaphragm movement. The piston is biased to a normally open position in engagement with the diaphragm, while the pin is supported in a central bore in the housing for movement toward and away from the valve seat in the die cast housing structure. By this arrangement, a metal to metal valving structure is achieved obviating many of the problems encountered in prior art devices which relied on elastomeric sealing elements. A double seal arrangement for the shaft of the pin serves to isolate the chambers but allows fairly unrestricted travel of the pin due in part to its relatively small diameter and ease of sealing same. The housing parts are bolted together as an assembly which can be readily disassembled for service procedures and the like.

DETAILED DESCRIPTION OF THE INVENTION

Figure 1:
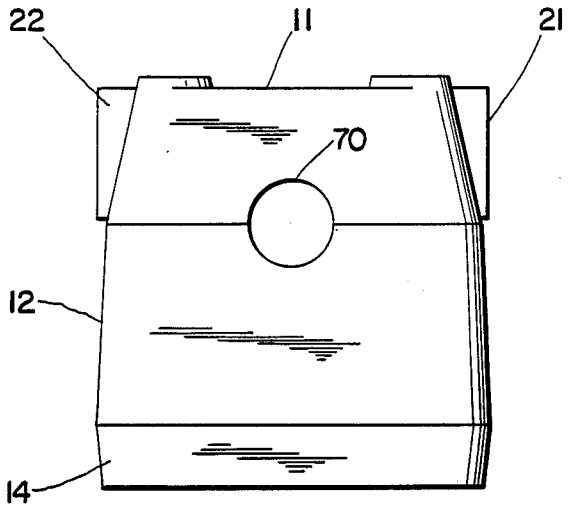
FIG. 1 is an elevational view of the coolant loss valve of the invention.
Figure 2:
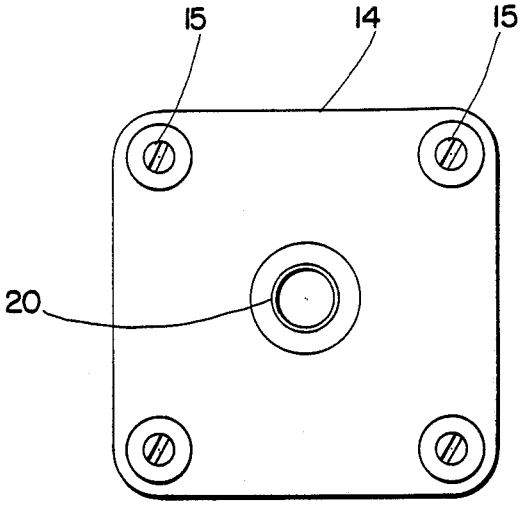
FIG. 2 is a bottom view of the coolant loss valve.

Referring now to the drawings there is shown a preferred embodiment of the coolant loss valve 10 which essentially consists of a three-part housing comprising aluminum head 11, main valve housing 12 and housing cap 14, all of which are secured together as a unit by means of bolts 15 passing through the housings 12, 14 and being threaded into apertures in the housing head portion 11. The housing is generally square in configuration as best seen in FIG. 2 and includes a coolant port 20 located in a boss on the outer side of housing cap 14. Aluminum head 11 is a die casting also generally in a square configuration including an inlet port 21 at one side thereof and an outlet port 22 opposite thereto. Housing head 11 further includes inlet bore 24 and outlet bore 25 extending end to end in a horizontal direction and a transverse central bore 26. Bore 26 extends vertically and terminates in a bottom wall 28, having a central orifice or main valve seat 30 therein, joining the inlet and outlet bores 24, 25 respectively. Inlet port 21 and outlet port 22 are internally threaded and adapted for receipt of conduit for transmitting fluid flow through coolant valve 10. Typically, inlet port 21 is connected to the oil pressure line at the downstream side of a master control valve in a diesel engine protection system or the like, while outlet port 22 may receive conduit which leads to the sump of an engine lubrication system.

Main housing 12 is also generally square in configuration having four substantially identical side walls 32 extending between housing cap 14 and head structure 11. A generally circular funnel 35 is located in the center of housing 12 and has its wide end joined to side walls 32 for support of the funnel. The funnel 35 further supports at the narrow end thereof, central boss 36 which extends vertically both upwardly of funnel 35 and downwardly within the funnel structure itself. Boss 36 is slidably received in a friction fit within bore 26 of head structure 11 and is sealed therein by means of O-ring 38 trapped between shoulders in bore 26 and boss 36 respectively.

Housing cap 14, although having a square outer periphery, includes a raised circular boss 41 therein, having annular groove 42 at its outer periphery. The edge of a circular elastomeric diaphragm 44 is received in groove 42 and is trapped therein between boss 41 and side walls 32 of main housing 12 which are internally formed in a circular configuration at this location. Diaphragm 44 thus is in fluid communication with coolant inlet port 20 and forms together with end cap 14, expansible chamber 45. Diaphragm 44 is of the rolling diaphragm type and includes a reversely folded peripheral edge 46 thereon, which allows extension of diaphragm 44 into main housing 12 with substantially little resistance to such elongation.

A circular plastic piston 50 consisting of a flat circular disc having a raised edge and central hub 52 is supported adjacent diaphragm 44 for movement therewith. A stainless steel cylindrical pin 55 is pressed into hub 52 and extends vertically from piston 50 forming a pin and piston assembly which moves together with elastomeric diaphragm 44. Pin 55 is slidably received in a vertical bore 58 in boss 36 of housing 12 for movement toward and away from main valve seat 30. Pin 55 is a relatively slender pin being on the order of 5/32 inch diameter and is engageable with wall 28 to fully cover main valve seat 30 which is on the order of 3/32 inch diameter. Pin 55 is further supported for vertical axial movement in boss 36 by means of a pair of sleeves 60 and sealed by a pair of ring seals 62. A compression spring 65 is disposed between the narrow end of funnel 35 and piston 50 adjacent central boss 52 to urge piston 50 into engagement with diaphragm 44 so that the piston and pin assembly follows the movement of diaphragm 44 for opening and closing of main valve seat 30.

Figure 3:
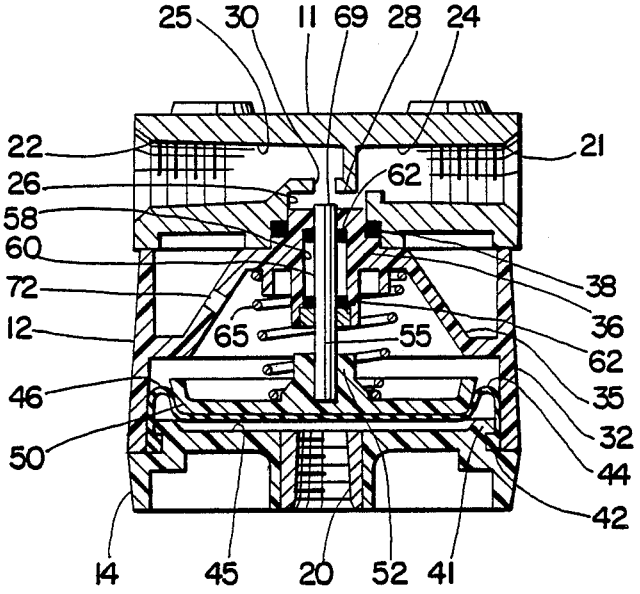
FIG. 3 is an elevational view in cross-section of the coolant loss valve of the invention.

In FIG. 3 coolant loss valve 10 is shown in a deenergized condition in the absence of fluid under pressure applied at coolant port 20 with spring 65 urging piston 50 and diaphragm 44 to a lowermost position adjacent housing cap 14. In this position the free end 69 of pin 55 is spaced from valve seat 30 to allow the flow of fluid from inlet port 21 to outlet port 22. End 69 of pin 55 is flat and transverse to the vertical axis of the pin and is readily formed in this manner to achieve a suitable seal with main valve seat 30. As pressure is applied at coolant inlet 20, elastomeric diaphragm 44 will move to an upper position acting against the bias of spring 65 and moving pin 55 upwardly into engagement with valve seat 30 to close the latter and prevent the flow of fluid from inlet port 21 to outlet port 22. A vent port 70 is included in housing 12 being located at the junction between housing 12 and head structure 11 and communication with the area enclosed by housing walls 32. An orifice 72 is included in funnel 35 to provide communication with the volume between funnel 35 and piston 50 so that fluid trapped therein may freely breathe externally of housing 12 so as not to restrict movement of the piston.

By virtue of this design, a more efficient operation of the coolant loss valve 10 is realized. For example, because of the minimal diameter of pin 55, very little frictional effects are introduced by seals 62 and supporting sleeves 60 which could become fouled by contaminants in the fluid being routed between inlet and outlet ports 21, 22 and which could prevent reliable and repeatable movement of the pin and piston assembly. Further, the diameter of diaphragm 44 is relatively large in relation to the diameter of pin 55 providing a significantly large fluid ratio to overcome any frictional effects created by the elastomeric material of seals 62 or by contamination in bore 58. Still further, the combination of the stainless steel material in pin 55 in conjunction with the die cast aluminum structure forming wall 28 at main valve seat 30 provides surfaces which are not susceptible to fouling or the accumulation of contaminants resulting in a reliable action of the valving therein.

We claim:

1. An improved coolant loss valve for engine protective systems and the like, comprising a valve body having an inlet port, an outlet port and a main valve seat for transmitting fluid between said inlet and outlet ports, said valve body having a recess therein with said valve seat disposed at the end of said recess, a valve housing supported on said valve body, an elastomeric diaphragm sealingly received in said valve housing forming an expansible pressure chamber, a coolant pressure port in said valve housing in fluid communication with said pressure chamber, a piston adjacent said diaphragm, spring means biasing said piston into engagement with said diaphragm for following the movement of said diaphragm, and a small diameter pin slidably received in said housing and fixed at one end to said piston for support thereof, the other end of said pin being a valve member engageable with said valve seat for controlling fluid flow from said inlet port to said outlet port.

2. The valve as set forth in claim 1 wherein said housing comprises a boss thereon receivable in said recess of said valve body, said boss having a central bore therein, and means in said bore for slidably supporting and sealing the shaft of said pin.

3. The valve as set forth in claim 2 wherein said supporting and sealing means comprises a pair of spaced ring seals and a pair of spaced sleeves.

4. The valve as set forth in claim 3 wherein said valve housing comprises a cap member having said coolant pressure port therein, said elastomeric seal being engaged at its periphery between said cap member and the remainder of said housing for sealing the periphery of said expansible chamber.

5. The valve as set forth in claim 4 wherein said cap member has a circular boss thereon with an annular groove at its periphery and said elastomeric seal is received in said annular groove.

6. The valve as set forth in claim 5 wherein said housing has a funnel structure therein terminating at the narrow end thereof in said housing boss.

7. The valve as set forth in any one of claims 1–6 wherein said elastomeric diaphragm is a rolling diaphragm having a reversely folded peripheral edge thereon.

8. A coolant loss valve, comprising a three-part housing including a die cast aluminum head, a main plastic housing and a housing cap, inlet and outlet ports and a main valve seat in said head, a coolant port in said housing cap and a vent port in said main housing, an elastomeric rolling diaphragm supported in said main housing at the junction of said housing cap, said diaphragm being circular and joined at its periphery to said housing cap in sealing engagement, a funnel structure in said main housing supporting a central boss at its narrow end, a piston and pin assembly slidably received in said boss with said piston in engagement with said diaphragm and said pin extending through said boss for engagement with said main valve seat, and a spring engaged between said funnel structure and said piston for biasing said piston into engagement with said diaphragm, whereby said pin is moved toward and away from said valve seat in response to pressure variations at said coolant port.

9. The valve as set forth in claim 8 wherein said vent port is positioned at the junction of said head and said main housing and said funnel structure includes a vent orifice therein.

10. The valve as set forth in claim 9 wherein said three-part housing is in a square configuration, said housing cap having a circular boss thereon for receiving said elastomeric diaphragm.

11. The valve as set forth in claim 10 wherein said boss at the end of said funnel structure is received in a bore in said head, and an o-ring seal is disposed in said bore for sealing between said head and said main housing.

12. The valve as set forth in claim 11 wherein said valve seat is disposed at the bottom of said bore in said head.

* * * * *